United States Patent [19]

Broes

[11] 4,069,782

[45] Jan. 24, 1978

[54] SHIP STRUCTURE

[76] Inventor: Frank Broes, 1351 Airport Entrance Road, Jacksonville, Fla. 32218

[21] Appl. No.: 616,597

[22] Filed: Sept. 25, 1975

Related U.S. Application Data

[60] Division of Ser. No. 431,132, Jan. 14, 1974, Pat. No. 3,908,573, which is a continuation-in-part of Ser. No. 249,595, May 2, 1972, Pat. No. 3,786,772.

[51] Int. Cl.[2] ..... B63B 1/12

[52] U.S. Cl. ..... 114/61; 114/56; 114/63

[58] Field of Search ..... 114/56, 61, 63, 43.5 VC, 114/41, 66.5 R

[56] References Cited

U.S. PATENT DOCUMENTS

| | | | |
|---|---|---|---|
| 143,003 | 9/1873 | Ford | 114/41 |
| 1,599,311 | 9/1926 | Chimaug | 114/56 |
| 2,440,345 | 4/1948 | Neel | 114/61 |

*Primary Examiner*—Trygve M. Blix
*Assistant Examiner*—Sherman D. Basinger

[57] ABSTRACT

The catamaran-type ship for hauling barges includes two parallel spaced hull forms each including its own bow. One or more additional bows, each partially defining a pair of water-receiving passageways respectively on opposite sides thereof, are disposed between the hull forms and extend rearwardly for only a portion of the length of the hull forms. An elongated platform structure for supporting barges in transit is disposed between the hull forms aft of the additional bow or bows. The platform structure extends rearwardly, from a front portion thereof adjacent the additional bow or bows, for a substantial portion of the remainder of the length of the hull forms, and is operatively connected to the hull forms for vertically reciprocal movement relative thereto. A pair of deflecting structures are disposed respectively on opposite sides of each bow to direct water from the water-receiving passageways downwardly and underneath the ship. The bows are flat on the bottom, sharply pointed, and have a leading edge which slopes upwardly and rearwardly from the tip of the bottom.

5 Claims, 22 Drawing Figures

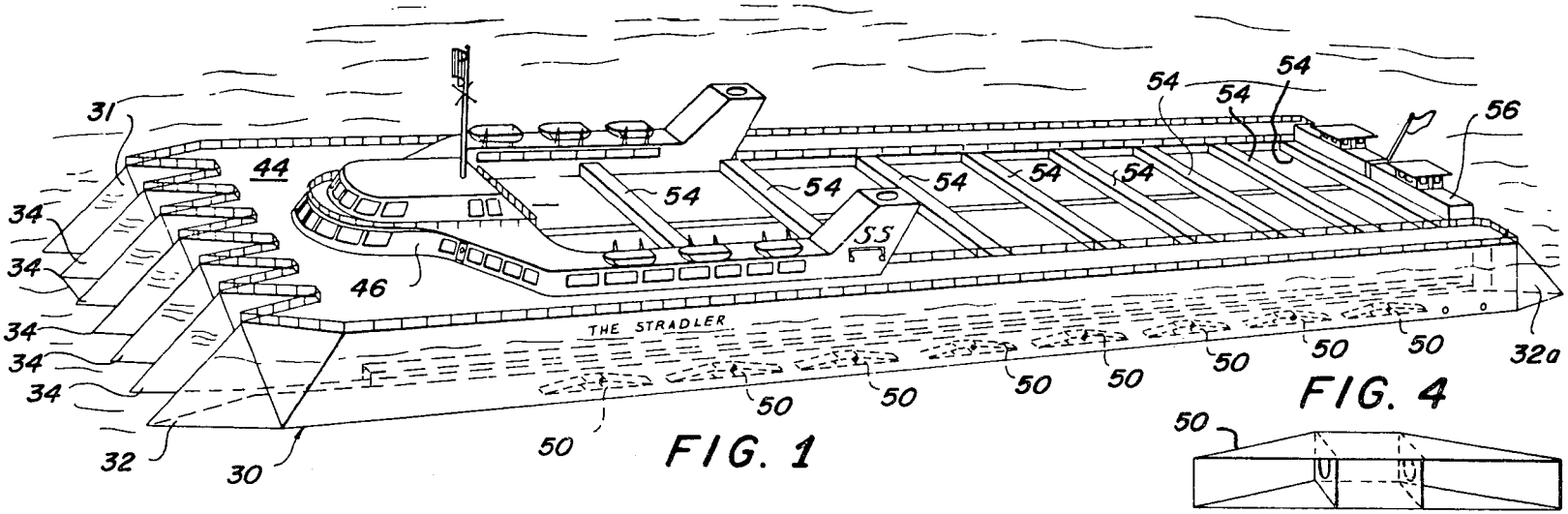
FIG. 1
FIG. 4
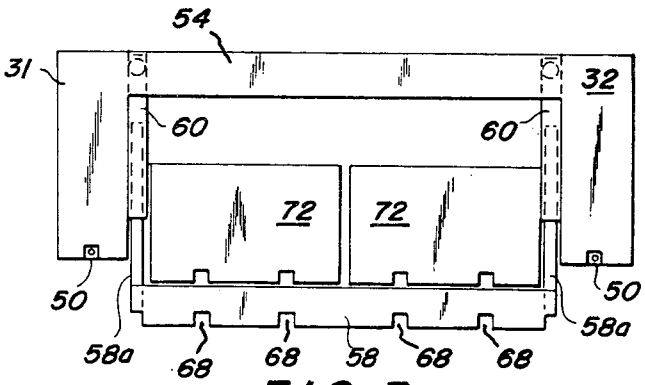
FIG. 3
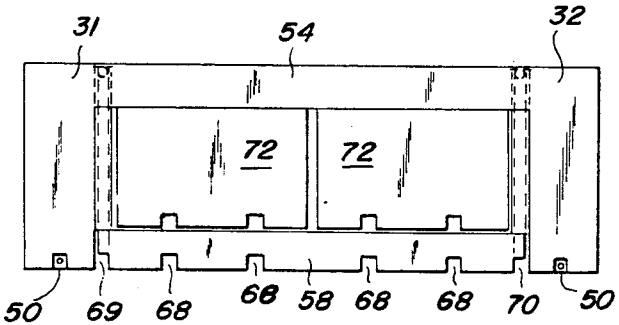
FIG. 2

SHIP STRUCTURE

This is a division of application Ser. No. 431,132, filed Jan. 14, 1974, now U.S. Pat. No. 3,908,573, which is a continuation-in-part of application Ser. No. 249,595, filed May 2, 1972, now U.S. Pat. No. 3,786,772.

An object of the invention is to provide an improved catamaran-type ship for transporting barges.

Another object is to provide a barge transporting ship having an improved bow construction which eliminates or greatly reduces the bow wave associated with former ships in transit, thereby greatly reducing the amount of energy required to propel the ship.

Other objects and advantages will become apparent to those skilled in the art when the following specification is considered along with the accompanying drawings in which:

FIG. 1 is perspective view of a ship constructed in accordance with the invention, with some hydraulic propulsion units being shown in phantom;

FIG. 2 is a transverse section through the ship of FIG. 1 showing a vertically movable platform structure thereof loaded with barges and in position for transit;

FIG. 3 is a view similar to FIG. 2, but showing the platform structure in a lowered position for receiving or unloading barges;

FIG. 4 is a schematic view of one of the hydraulic propulsion units;

Figure 5:
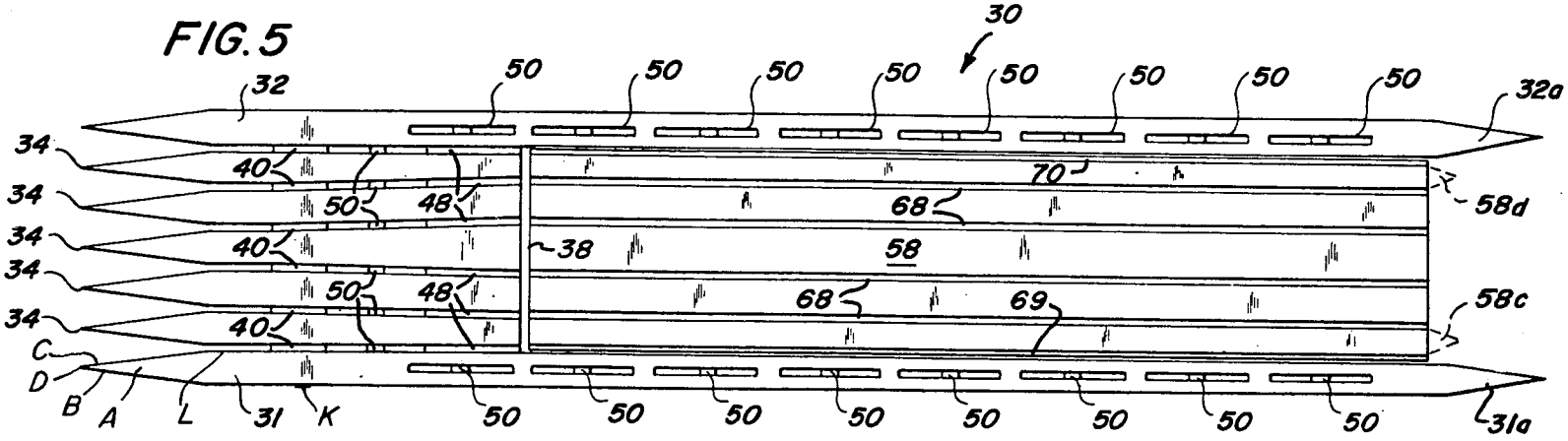
FIG. 5 is a bottom view of the ship of FIG. 1.
Figure 10:
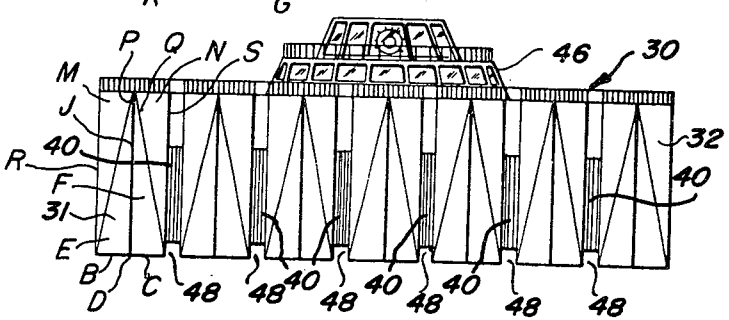
FIG. 10 is a front view of the ship of FIG. 1.
Figure 8:
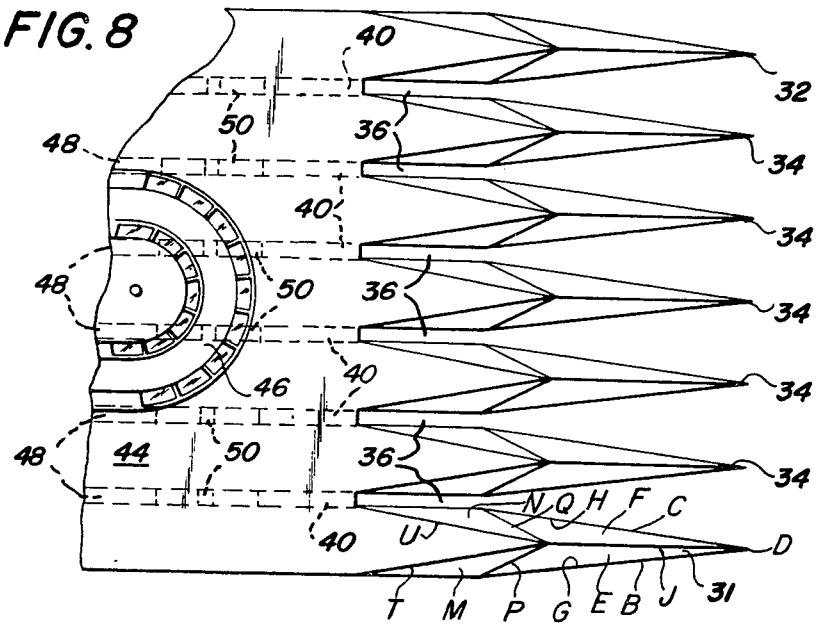
FIG. 8 is a fragmentary top view of the front portion of the ship of FIG. 1.
Figure 9:
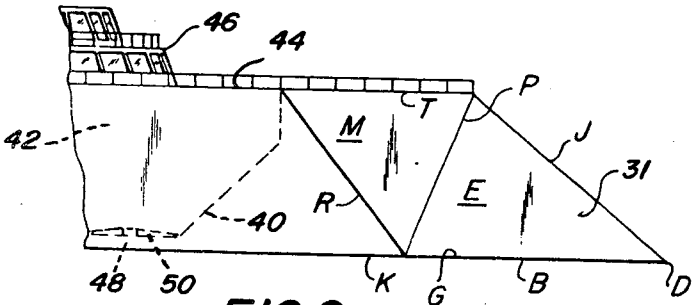
FIG. 9 is a fragmentary side view of the front portion of the ship of FIG. 1.

With reference to the drawings, FIGS. 1, 5, and 10 show a ship 30 constructed in accordance with the invention and including a pair of spaced, generally parallel, generally transversely aligned, elongated hull forms 31 and 32 extending the length of the ship. In accordance with the invention, at least one bow 34 is disposed between the hull forms 31 and 32, there being five bows 34 disposed between the hull forms 31 and 32 in the embodiment of the invention illustrated. The bows 34 and corresponding portions of the hulls 31 and 32 are relatively sharply pointed and each has a leading edge which slopes upwardly and rearwardly from the tip of its bottom. Each bow 34 has a front portion transversely spaced on each side from an adjacent bow or hull form and partially defining a pair of water-receiving passageways 36 respectively on opposite sides thereof, six of the passageways 36 being shown in FIG. 8. The bows 34 extend rearwardly for only a portion of the length of the hull forms 31 and 32, to a plate 38 shown only in edge view in FIG. 5. Each bow 34 has a pair of deflecting plate structures 40 (FIGS. 8 – 10) disposed respectively on opposite sides thereof and sloping downwardly and rearwardly substantially to the bottom of the bow to direct water in the water-receiving passageways 36 downwardly when the ship 30 is moving forwardly. Rearwardly of the plate structures 40 the bows 34 have no sides, a service and equipment room 42 (FIG. 9) extending from the plate structures 40 to the plate 38 (FIG. 5) and extending transversely across the bows 34 into the hull forms 31 and 32. The tops of the rear portions of the bows 34 merge to form a deck 44 on which a ship's bridge 46 is located. The bottoms of the rear portions of the bows 34, rearwardly of the plate structures 40, are joined together and to the hull forms 31 and 32 by inverted channel structures to provide six channels 48 (FIGS. 5, 8, 9, and 10) communicating respectively with the water-receiving passageways 36 and extending generally parallel to the hull forms 31 and 32.

Each of the channels 48 has a hydraulic propulsion unit 50 (FIGS. 5, 8, and 9) operatively associated therewith at a front portion thereof just rearwardly of the respective deflecting plate structure 40. A hydraulic propulsion unit 50 is schematically illustrated in FIG. 4 and may be constructed in accordance with the structure disclosed in my application Ser. No. 237,717, and now U.S. Pat. No. 3,782,114 filed Mar. 23, 1972. Each of the hull forms 31 and 32 also has a plurality of hydraulic propulsion units 50 spaced longitudinally along the bottom thereof. Similar hydraulic propulsion units 51, turned sideways, are shown in the embodiment of the invention illustrated in FIGS. 6 and 7, to illustrate their use for steering purposes.

Rearwardly of the plate 38 (FIG. 5) the hull forms 31 and 32 are connected at upper portions by a plurality of transversely extending box beams 54 (FIG. 1). A stern operating bridge 56 is disposed adjacent the rearmost beam 54.

Figure 12:
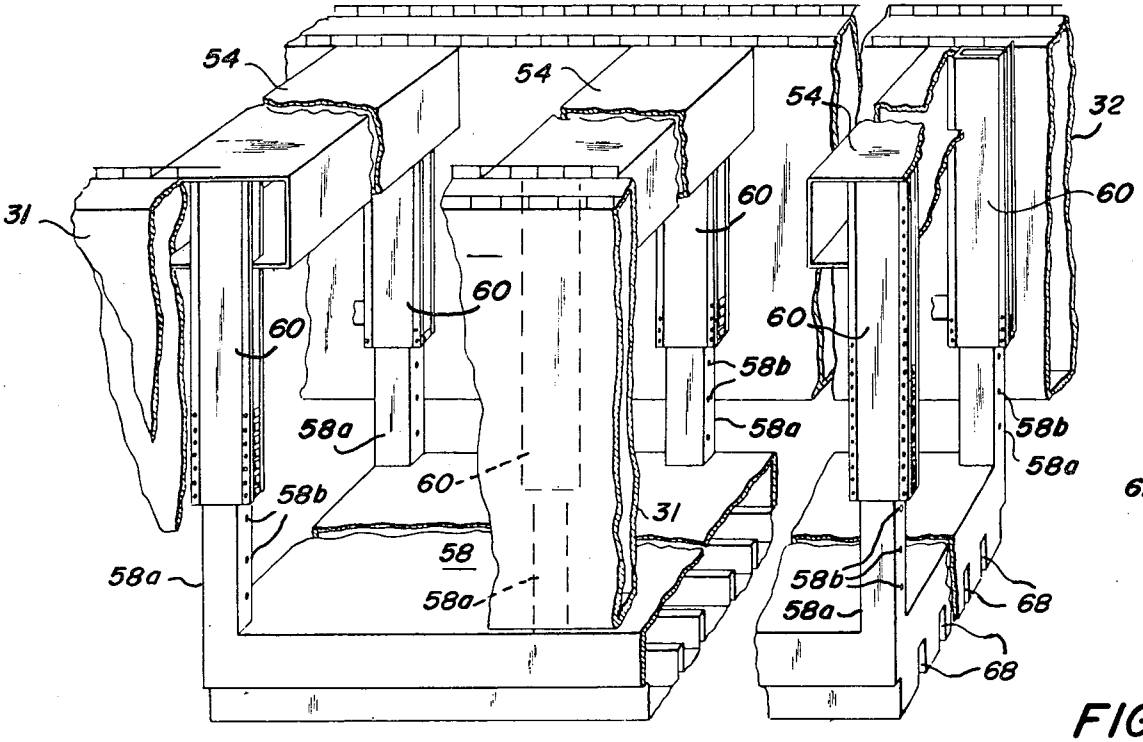
FIG. 12 is a fragmentary perspective view of the platform structure of the ship of FIG. 1 with upstanding post portions reciprocally received respectively in well structures attached to outer hull forms of the ship.

An elongated platform structure 58 (FIGS. 2, 3, 5, and 12) is disposed between the hull forms 31 and 32 aft of the bows 34 and extends rearwardly, from a front portion thereof adjacent the plate 38, for the greater portion of the remainder of the length of the hull forms 31 and 32, only reverse shear stern portions 31*a* and 32*a* of the hull forms 31 and 32 projecting beyond the rear end of the platform structure 58 in the embodiment shown. As shown in FIG. 12, the platform structure 58 is hollow and is provided with a plurality of upstanding box post portions 58*a* reciprocably received respectively in a plurality of guide well structures 60 secured to the respective hull forms 31 and 32 and having upper end portions disposed in the respective box beams 54. The guide well structures 60 and the box post portions 58*a* constitute cooperative guide means at the inner sides of the hull forms and at opposite sides of the platform structure operatively connecting the platform structure to the hull forms for vertically reciprocal movement thereto. Each of the box post portions 58*a* is provided on at least one side and preferably on a pair of opposite sides with a plurality of vertically spaced holes 58*b* for reception of a locking pin (not shown), the guide well structures 60 also having a plurality of vertically spaced holes (not shown) on corresponding sides. A locking pin extending through at least the four end guide well structures 60 and the corresponding box post portions 58*a* locks the platform structure 58 against vertical movement with respect to the hull forms 31 and 32.

Figure 13:
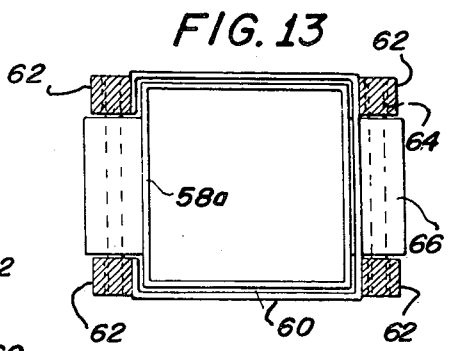
FIG. 13 is a transverse section through one of the post portions and its well structure.
Figure 14:
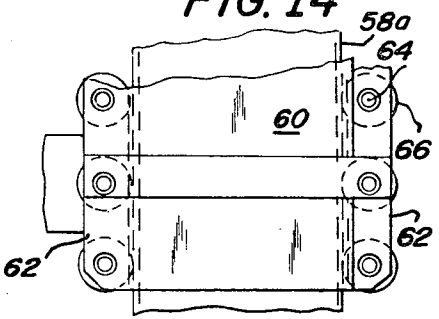
FIG. 14 is a fragmentary side view of a post portion and its well structure looking endwise of rollers carried by the well structure.
Figure 15:
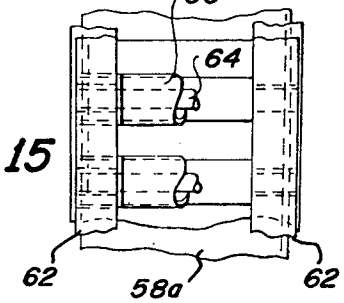
FIG. 15 is a fragmentary side view of a post portion and its well structure looking transversely of rollers carried by the well structure.

As best shown in FIGS. 13 - 15, each guide well structure 60 is provided with four corner blocks 62. A plurality of vertically spaced horizontally extending shafts 64 are carried by each pair of blocks 62 on opposite sides of the guide well structure 60, each shaft 64 carrying a roller 66 for engagement with the box post portion 58*a*, and the guide well structure 60 being slotted at the locations of the rollers.

The bottom of the platform structure 58 is formed to provide four channels 68 extending longitudinally for the complete length of the platform structure, and outer edge portions of the bottom of the platform structure are formed to provide a pair of outer channels 69 and 70, the inner side of the hull form 31 forming one side of the channel 69 and the inner side of the hull form 32 forming one side of the channel 70, as best shown in FIG. 2. The channels 68, 69, and 70 communicate respectively with the six channels 48 when the platform structure 58 is in the vertically adjusted position of FIG. 2, a loaded position for transit. The platform structure 58 may be provided with a pair of reverse shear stern configurations 58*c* and 58*d*, indicated in broken lines in FIG. 5, if desired.

Figure 7:
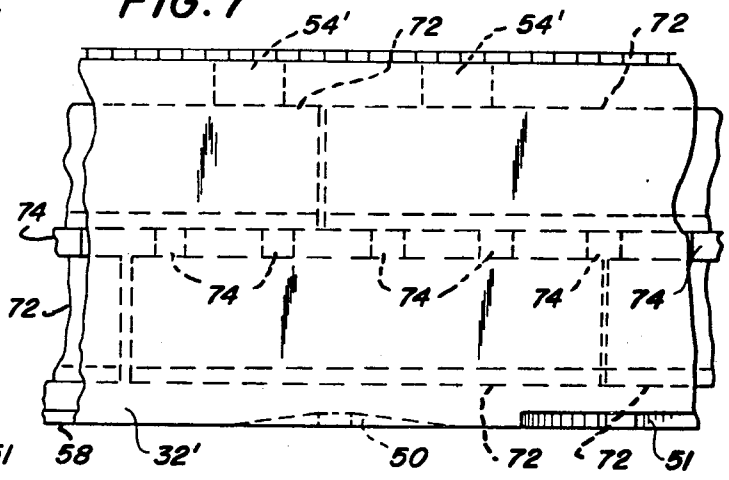
FIG. 7 is a fragmentary side view of the modification of FIG. 6.
Figure 6:
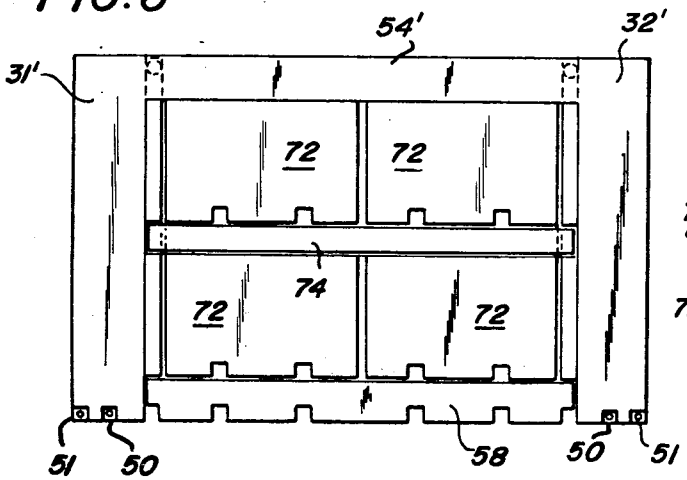
FIG. 6 is a view similar to FIG. 2, but showing a modification in which a double layer of barges can be accommodated.
Figure 11:
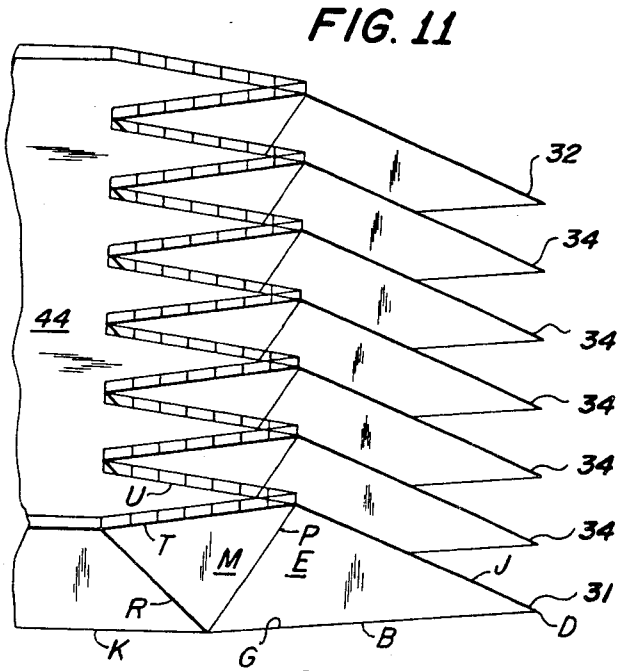
FIG. 11 is a fragmentary perspective view of the front portion of the ship of FIG. 1.

The platform structure 58 may be lowered, by flooding the interior thereof, to a loading or unloading position such as shown in FIG. 3. Two rows of floating barges 72 can then be driven between the hull forms 31 and 32 above the platform structure 58 into or out of the ship 30 at the stern end thereof. If the barges 72 are being loaded into the ship 30, after they are above the platform structures 58, the platform structure is raised to the position of FIG. 2 to clamp the barges against the beams 54 for transit. The raising operation includes pumping or blowing the water back out of the interior of the platform structure to render it bouyant, and also raising it by chains through the use of hydraulically or electric motor operated mechanism in the box beams 54. FIGS. 6 and 7 show a modification in which four rows of barges 72 can be hauled, two rows in each of two layers. The upper layer is carried by a plurality of spaced, transversely extending, chain-operated beams 74 and the lower layer is carried by a platform structure 58 identical to that of FIGS. 2 and 3.

Figure 16:
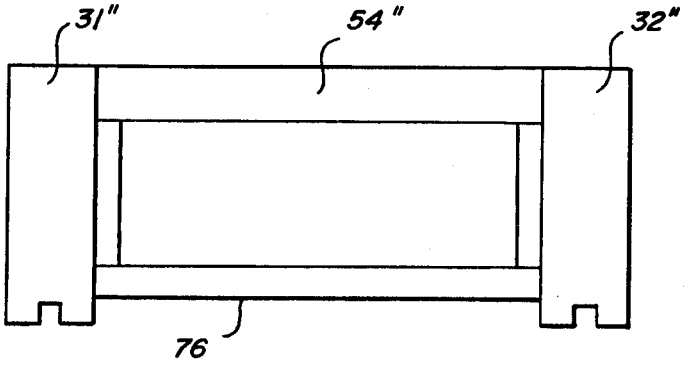
FIG. 16 is a modification of the structure of FIG. 2 showing replacement of the platform structure by a plurality of spaced, chain-operated beams.

FIG. 16 shows a modification in which a plurality of spaced, transversely extending beams 76 similar to the beams 74 of FIGS. 6 and 7 replace the platform structure 58 of FIG. 2.

Figure 17:
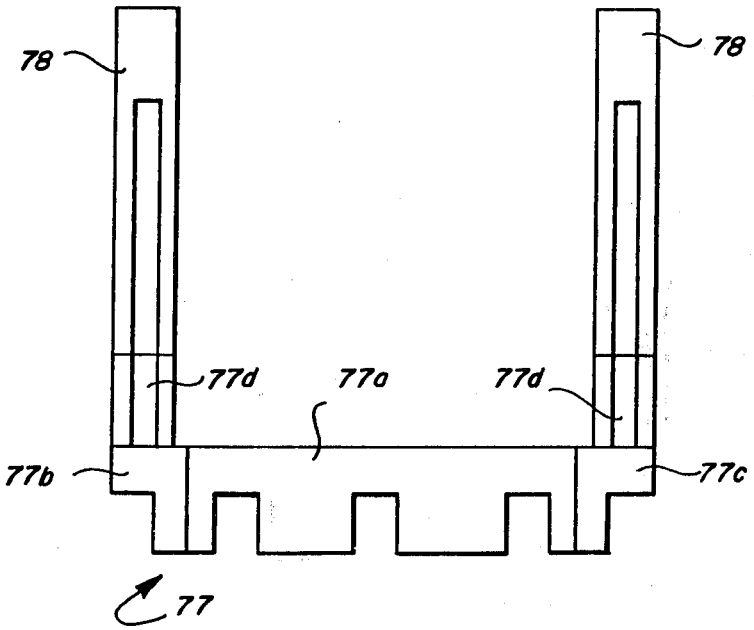
FIG. 17 is an end view of a modified platform structure and well structures for its post portions.

FIG. 17 shows a modified platform structure 77 including a floodable center compartment 77*a* and a pair of pump rooms 77*b* and 77*c* disposed on opposite sides thereof, all extending the full length of the platform structure 77. The pump room 77*b* and 77*c* are accessible through hollow upstanding post portions 77*d* reciprocably received in guide well structures 78 attached to hull forms not shown.

Figure 18:
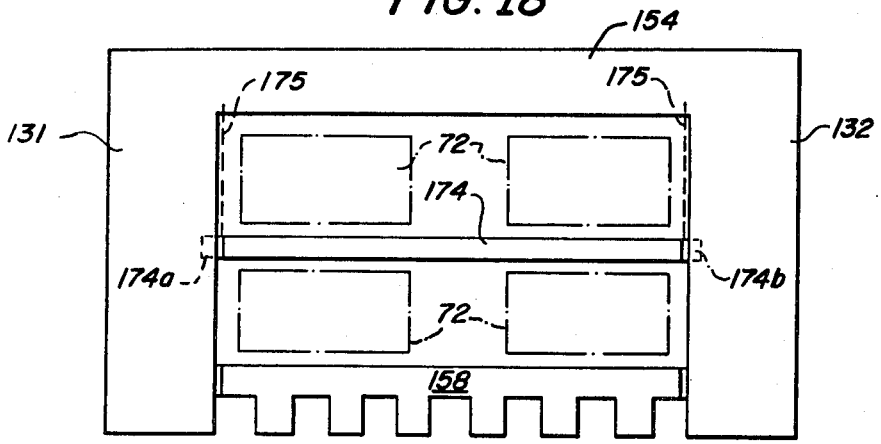
FIG. 18 is a transverse section similar to FIG. 6, but showing a modification in which beams supporting the upper layer of barges and a platform structure supporting the lower layer of barges are keyed to opposite hull forms.
Figure 19:
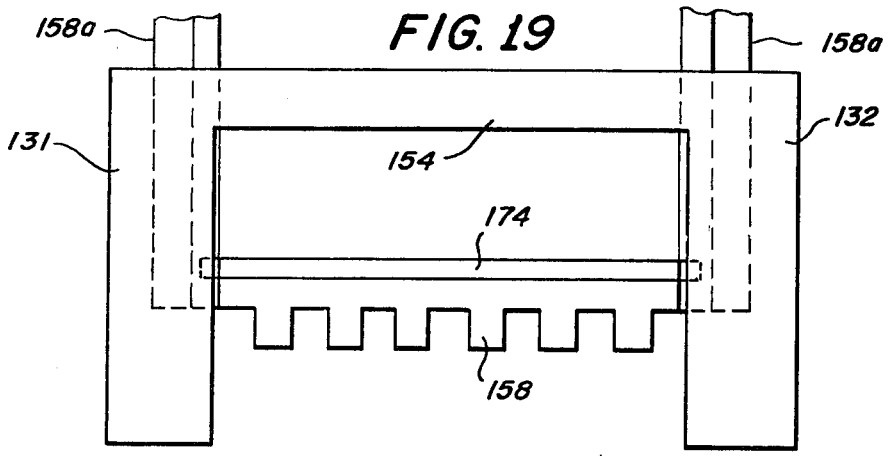
FIG. 19 is a view similar to FIG. 18, but showing the platform structure in a raised position for transit without a load of barges.
Figure 21:
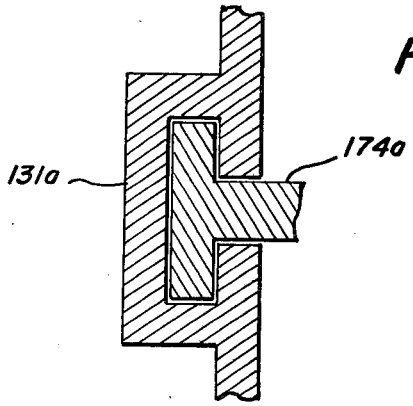
FIG. 21 is a fragmentary sectional view showing an end portion of one of the beams supporting the upper layer of barges and an adjacent portion of a hull form.
Figure 22:
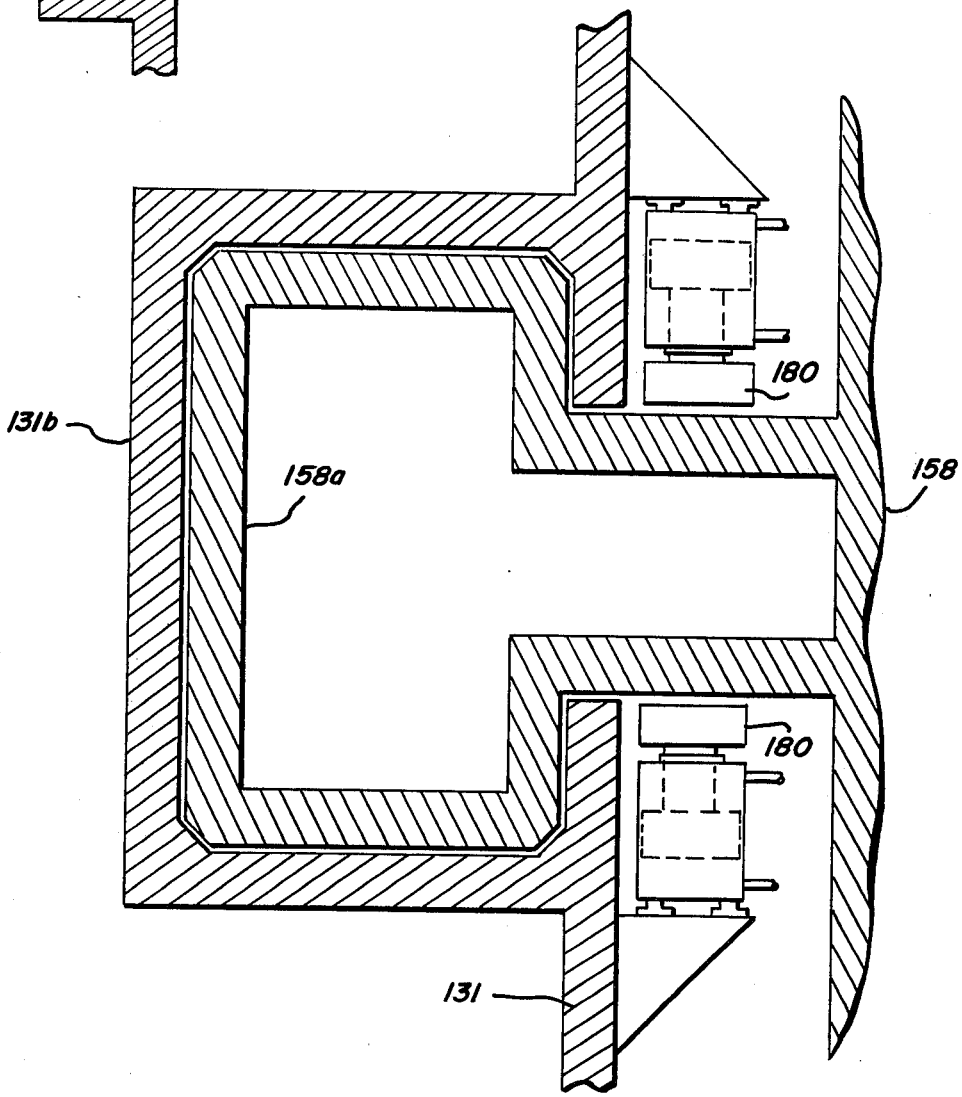
FIG. 22 is a fragmentary transverse section of a modified post portion of a platform structure and an adjacent portion of a hull form.

FIG. 18 shows a modification of the structure of FIG. 6. In FIG. 18 a plurality of spaced beams 174 operable by chains 175 support an upper layer of barges 72. Opposite end portions 174*a* and 174*b* of the beams 174 are keyed respectively to the hull forms 131 and 132, as best shown in FIG. 21 for an end portion 174*a* of one of the beams. The end portion 174*a* is T-shaped and is reciprocably received in a mating hull portion 131*a* of the hull form 131. An elongated platform structure 158 supports a lower layer of barges 72. As indicated in FIG. 19, the platform structure is provided with upstanding post portions 158*a* which are keyed respectively to the hull forms 131 and 132. As best shown in FIG. 22 with respect to the hull form 131, the post portions 158*a* are hollow and T-shaped and are reciprocably received in mating hull portions such as a hull portion 131*b*. The hull portions 131*a* and 131*b* are disposed at different places along the length of the hull 131. Hydraulically operated brake means 180 secured to the hull forms 131 and 132 on opposite sides of each post portion 158*a* may be used to brake the movement of the platform structure 158 and to lock it in any particular vertically adjusted position. Cover means (not shown) may be removed from the top of the box beams 154 (FIGS. 18 and 19) adjacent opposite ends to provide access to the hollow interior of the post portions 158*a* and thereby to pump rooms in the platform structure 158. With the cover means (not shown) removed and no barges 72 in place, the beams 174 can be secured to the platform structure 158 and both the beams and the platform structure raised as a unit by the chains 175 until the platform structure 158 engages the beams 154. The post portions 158*a* will then project above the beams 154 as shown in FIG. 19. With the platform structure 158 raised above the surface of the water, the bottom thereof can be cleaned, and also there will be less water friction when the ship is travelling without load.

It should also be noted that the platform structures 58 and 158 can be lowered by flooding, to extreme lower positions lower than that shown for the platform structure 58 in FIG. 3, locked in the extreme lower position, and then pumped out. This will raise the hull forms above the surface of the water for servicing the hydraulic propulsion units 50 or cleaning the bottoms of the hull forms. Because the platform structures and the hull forms can alternately be raised above the surface of the water, the ships such as ship 30 are self-dry-docking.

The post portions 158*a* and the mating hull portions such as hull portion 131*b* constitute cooperative guide means at the inner sides of the hull forms and at opposite sides of the platform structure operatively connecting the platform structure to the hull forms for vertically reciprocal movement relative thereto.

Figure 20:
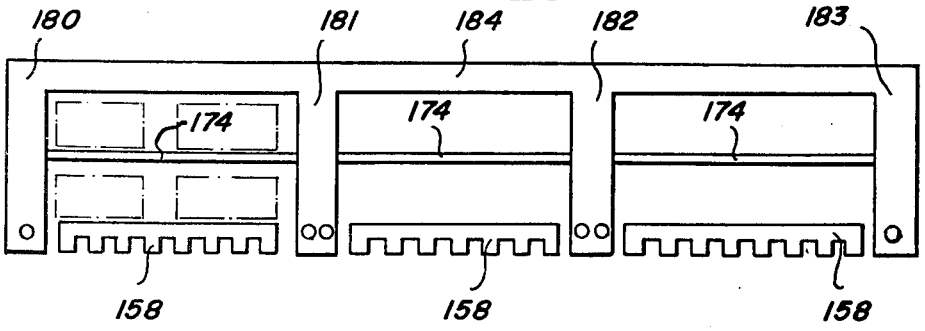
FIG. 20 is a transverse section of a modification embodying four hull forms and three platform structures and sets of beams.

FIG. 20 shows a modification in which four hull forms 180, 181, 182 and 183 are joined together transversely by a plurality of spaced beams 184 and three sets of the beams 174 and three platform structures 158 are provided.

Each of the bows 34 and corresponding portions of the hull forms 31 and 32 has a simple triangular plate construction which for simplicity is described hereafter, with reference to FIGS. 5, 8, 9, 10, and 11, only for the hull form 31.

The hull form 31 includes a generally flat bottom plate A (FIG. 5) partially defined by a pair of convergent straight edges B and C meeting substantially at a point D, and a first pair of generally triangular substantially identical side plates E and F (FIGS. 8 – 11) having base edges G and H respectively substantially collinear and coextensive with the convergent edges B and C of the bottom plate A and each having a first side edge J convergent with a respective one of the convergent edges B and C of the bottom plate A and substantially collinear and coextensive with a corresponding first side edge J of the other.

The bottom plate A is partially defined also by a pair of spaced generally parallel straight edges K and L (FIG. 5) joined respectively to the convergent edges B and C and the bow also includes a second pair of generally triangular substantially identical side plates M and N (FIGS. 8 – 11) each having a first side edge P and Q respectively substantially collinear and coextensive with a second side edge of a respective one of the first pair of side plates E and F, each having a second side edge R and S respectively generally coplanar in a substantially vertical plane with a respective one of the parallel edges K and L of the bottom plate A and convergent therewith at a point where the respective one of the parallel edges K and L of the bottom plate A joins the respective one of the convergent edges B and C of the bottom plate A, and each having an upper base edge T and U respectively convergent with the upper base edge of the other of the second pair of side plates M and N at a point where it converges with the first side edge P and Q respectively of its respective one of the second pair of side plates M and N.

Various modifications can be made in the structure shown and described without departing from the spirit and scope of the invention as set forth in the claims appended hereto.

I claim:

1. A ship structure comprising a pair of spaced, generally parallel, generally transversely aligned, elongated hull forms, a bow secured between the hull forms and having a front portion transversely spaced from each of the hull forms and partially defining a pair of water-receiving passageways respectively on opposite sides thereof, the bow extending rearwardly for only a portion of the length of the hull forms, an elongated platform structure disposed between the hull forms aft of the bow, and cooperative guide means at the inner sides of the hull forms and at opposite sides of the platform structure operatively connecting the platform structure to the hull forms for vertically reciprocal movement relative thereto, the bow including a generally flat bottom plate partially defined by a pair of convergent straight edges meeting substantially at a point, and the bow also including a first pair of generally triangular substantially identical side plates having base edges substantially collinear and coextensive respectively with the convergent edges of the bottom plate and each having a first side edge convergent with a respective one of the convergent edges of the bottom plate and substantially collinear and coextensive with a corresponding first side edge of the other.

2. A ship structure as claimed in claim 1 wherein the bottom plate is partially defined also by a pair of spaced generally parallel straight edges joined respectively to the convergent edges and the bow also includes a second pair of generally triangular substantially identical side plates each having a first side edge substantially collinear and coextensive with a second side edge of a respective one of the first pair of side plates, each having a second side edge generally coplanar in a substantially vertical plane with a respective one of the parallel edges of the bottom plate and convergent therewith at a point where the respective one of the parallel edges of the bottom plate joins the respective one of the convergent edges of the bottom plate, and each having an upper base edge convergent with the upper base edge of the other of the second pair of side plates at a point where it converges with the first side edge of its respective one of the second pair of side plates.

3. A ship structure comprising a pair of spaced, generally parallel, generally transversely aligned, elongated hull forms, a bow secured between the hull forms and having a front portion transversely spaced from each of the hull forms and partially defining a pair of water-receiving passageways respectively on opposite sides thereof, and a pair of deflecting means disposed respectively on opposite sides of the bow and sloping downwardly and rearwardly substantially to the bottom of the bow to direct water in the water-receiving passageways downwardly when the ship structure is moving forwardly, the bow including a generally flat bottom plate partially defined by a pair of convergent straight edges meeting substantially at a point, and the bow also including a first pair of generally triangular substantially identical side plates having base edges substantially collinear and coextensive respectively with the convergent edges of the bottom plate and each having a first side edge convergent with a respective one of the convergent edges of the bottom plate and substantially collinear and coextensive with a corresponding first side edge of the other.

4. A ship structure as claimed in claim 3 wherein the bottom plate is partially defined also by a pair of spaced generally parallel straight edges joined respectively to the convergent edges and the bow also includes a second pair of generally triangular substantially identical side plates each having a first side edge substantially collinear and coextensive with a second side edge of a respective one of the first pair of side plates, each having a second side edge generally coplanar in a substantially vertical plane with a respective one of the parallel edges of the bottom plate and convergent therewith at a point where the respective one of the parallel edges of the bottom plate joins the respective one of the convergent edges of the bottom plate, and each having an upper base edge convergent with the upper base edge of the other of the second pair of side plates at a point where it converges with the first side edge of its respective one of the second pair of side plates.

5. A bow for a ship, the bow comprising a generally flat bottom plate partially defined by a pair of convergent straight edges meeting substantially at a point and a pair of spaced generally parallel straight edges joined respectively to the convergent edges, a first pair of generally triangular substantially identical side plates having base edges substantially collinear and coextensive respectively with the convergent edges of the bottom plate and each having a first side edge convergent with a respective one of the convergent edges of the bottom plate and substantially collinear and coextensive with a corresponding first side edge of the other, and a second pair of generally triangular substantially identical side plates each having a first side edge substantially collinear and coextensive with a second side edge of a respective one of the first pair of side plates, each having a second side edge generally coplanar in a substantially vertical plane with a respective one of the parallel edges of the bottom plate and convergent therewith at a point where the respective one of the parallel edges of the bottom plate joins the respective one of the convergent edges of the bottom plate, and each having an upper base edge convergent with the upper base edge of the other of the second pair of side plates at a point where it converges with the first side edge of its respective one of the second pair of side plates.

* * * * *